US009685725B2

(12) United States Patent
Komoto et al.

(10) Patent No.: US 9,685,725 B2
(45) Date of Patent: Jun. 20, 2017

(54) CONNECTOR

(71) Applicant: JAPAN AVIATION ELECTRONICS INDUSTRY, LIMITED, Shibuya-ku, Tokyo (JP)

(72) Inventors: Tetsuya Komoto, Tokyo (JP); Osamu Hashiguchi, Tokyo (JP); Yu Tatebe, Tokyo (JP); Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/098,018

(22) Filed: Apr. 13, 2016

(65) Prior Publication Data

US 2016/0344121 A1 Nov. 24, 2016

(30) Foreign Application Priority Data

May 22, 2015 (JP) ..... 2015-104237

(51) Int. Cl.
*H01R 13/41* (2006.01)
*H01R 12/71* (2011.01)

(52) U.S. Cl.
CPC ..... *H01R 13/41* (2013.01); *H01R 12/712* (2013.01)

(58) Field of Classification Search
USPC ..... 439/66, 62, 628, 71, 74
See application file for complete search history.

(56) References Cited

U.S. PATENT DOCUMENTS 5,324,205 A * 6/1994 Ahmad ..... H01R 12/714 439/66
5,393,234 A * 2/1995 Yamada ..... H01R 12/721 439/62
6,425,785 B1 * 7/2002 Azuma ..... H01R 13/41 439/660
6,921,270 B2 * 7/2005 Mendenhall ..... H01R 13/2435 439/66
7,086,903 B2 * 8/2006 Takada ..... H01R 4/028 439/628
7,097,465 B1 * 8/2006 Korsunsky ..... H01R 13/40 439/74

(Continued)

FOREIGN PATENT DOCUMENTS

JP 06031088 U 4/1994
JP 2000323215 A 11/2000
JP 2011090867 A 5/2011

*Primary Examiner* — Alexander Gilman
(74) *Attorney, Agent, or Firm* — Holtz, Holtz & Volek PC

(57) ABSTRACT

A connector has contacts and a housing having holding grooves which accommodate the contacts. Each of the holding grooves has an inner wall extending in a first direction. Each of the contacts has a fixed portion, a contact arm portion and a support arm portion. The fixed portion is fixed to a corresponding one of the holding grooves. The contact arm portion and the support arm portion extend from the fixed portion in the first direction and are disposed apart from each other in a second direction. The contact arm portion has a contact point and is resiliently deformable to move the contact point in the second direction. The support arm portion comes into contact with the inner wall of the corresponding one of the holding grooves at least when the contact arm portion is resiliently deformed so that the contact point comes close to the support arm portion.

11 Claims, 16 Drawing Sheets

(56) References Cited

U.S. PATENT DOCUMENTS

| | | | | |
|---|---|---|---|---|
| 7,625,216 | B2 * | 12/2009 | Mendenhall | H01R 13/2435 439/66 |
| 7,766,670 | B1 * | 8/2010 | Ju | H05K 7/1061 439/70 |
| 8,047,874 | B2 * | 11/2011 | Ito | H01R 12/716 439/607.1 |
| 8,287,286 | B2 * | 10/2012 | Miwa | H01R 12/57 439/66 |
| 8,888,502 | B2 * | 11/2014 | Terhune, IV | H01R 12/7076 439/66 |
| 2010/0029100 | A1 * | 2/2010 | Ichimura | H01R 13/2428 439/66 |
| 2010/0029102 | A1 * | 2/2010 | Chen | H05K 7/1069 439/66 |

* cited by examiner

PPIOR ART

CONNECTOR

CROSS REFERENCE TO RELATED APPLICATIONS

Applicant claims priority under 35 U.S.C. §119 of Japanese Patent Application No. JP2015-104237 filed May 22, 2015.

BACKGROUND OF THE INVENTION

This invention relates to a connector, in particular, to a connector mounted on a board.

An example of this type connector is disclosed in JP 2000-323215 A (Patent Document 1). As shown in FIG. 32, the connector 900 of Patent Document 1 has a housing 910 and a terminal 920. The housing 910 is formed with a slot 911 for accommodating the terminal 920. Wall surfaces defining the slot 911 are opposed to each other and provided with protrusions 912 and 913 alternately. On the other hand, the terminal 920 has a holding portion 921, which abuts on the protrusions 912 and 913, and a projecting portion 922, which abuts on one of the wall surfaces. The connector 900 fixes the terminal 920 to the housing 910 by the two protrusions 912 and 913, which are provided on the wall surfaces of the housing 910, and the one projecting portion 922, which is formed in the terminal 920. In other words, the connector 900 fixes the terminal 920 to the housing 910 by three points which are disposed apart from one another in one direction (i.e. a Z-direction).

SUMMARY OF THE INVENTION

It is an object of the present invention to provide a connector having a lower profile.

One aspect of the present invention provides a connector which comprises a plurality of contacts and a housing. The housing has a plurality of holding grooves which accommodate the contacts, respectively. Each of the holding grooves has an inner wall extending in a first direction. Each of the contacts has a fixed portion, a contact arm portion and a support arm portion. The fixed portion is fixed in a corresponding one of the holding grooves. The contact arm portion and the support arm portion extend from the fixed portion in the first direction and are disposed apart from each other in a second direction perpendicular to the first direction. The contact arm portion has a contact point and is resiliently deformable to move the contact point in the second direction. The support arm portion comes into contact with the inner wall of the corresponding one of the holding grooves at least when the contact arm portion is resiliently deformed so that the contact point comes close to the support arm portion.

Another aspect of the present invention provides a connector assembly which comprises the connector and a mating connector mateable with the connector.

Not only the fixed portion but the support arm portion receive moment acted upon the contact. This allows lowering a height of the fixed portion, thereby achieving reduction of a profile of the connector.

An appreciation of the objectives of the present invention and a more complete understanding of its structure may be had by studying the following description of the preferred embodiment and by referring to the accompanying drawings.

Figure 1:
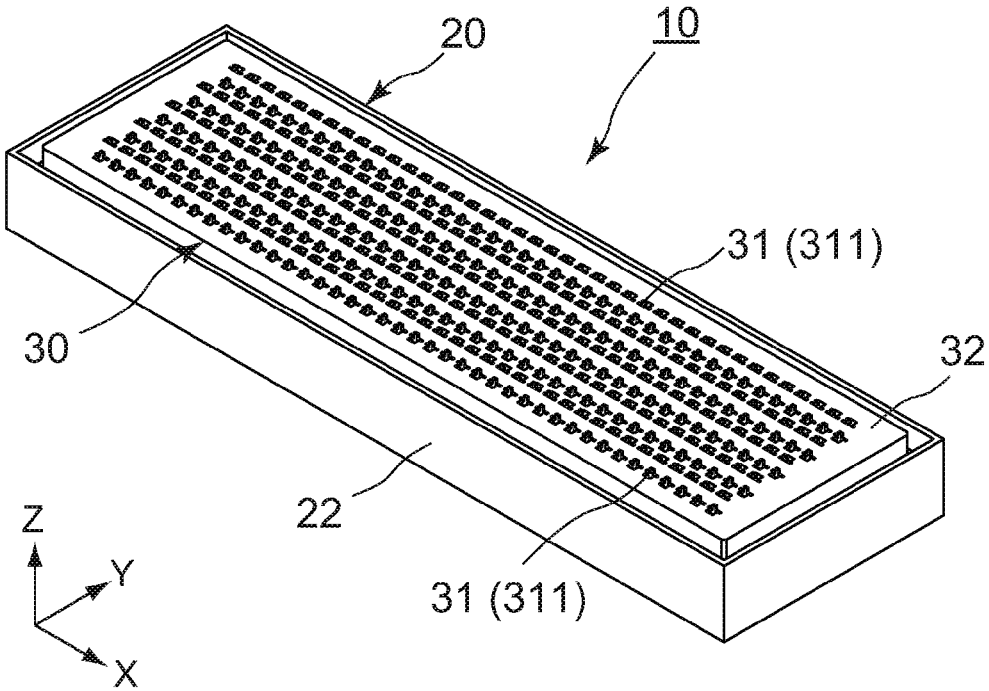
FIG. 1 is a top, perspective view of a connector assembly according to a first embodiment of the present invention. A connector (or a socket connector) and a mating connector (or a pin connector) are mated with each other after the mating connector is turned upside down to make an upper surface of the mating connector face an upper surface of the connector.
Figure 2:
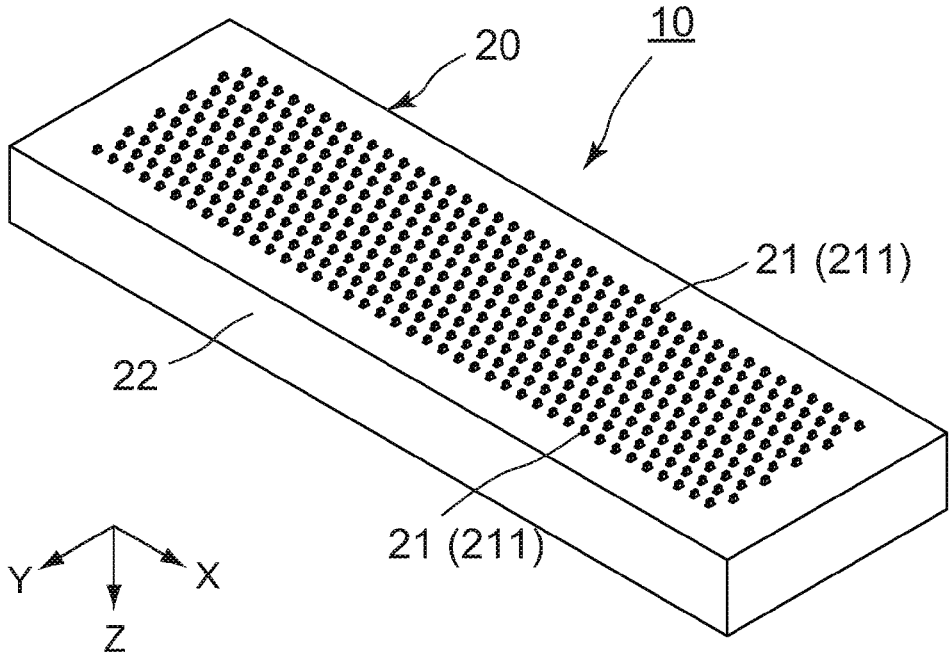
FIG. 2 is a bottom, perspective view of the connector assembly of FIG. 1.
Figure 3:
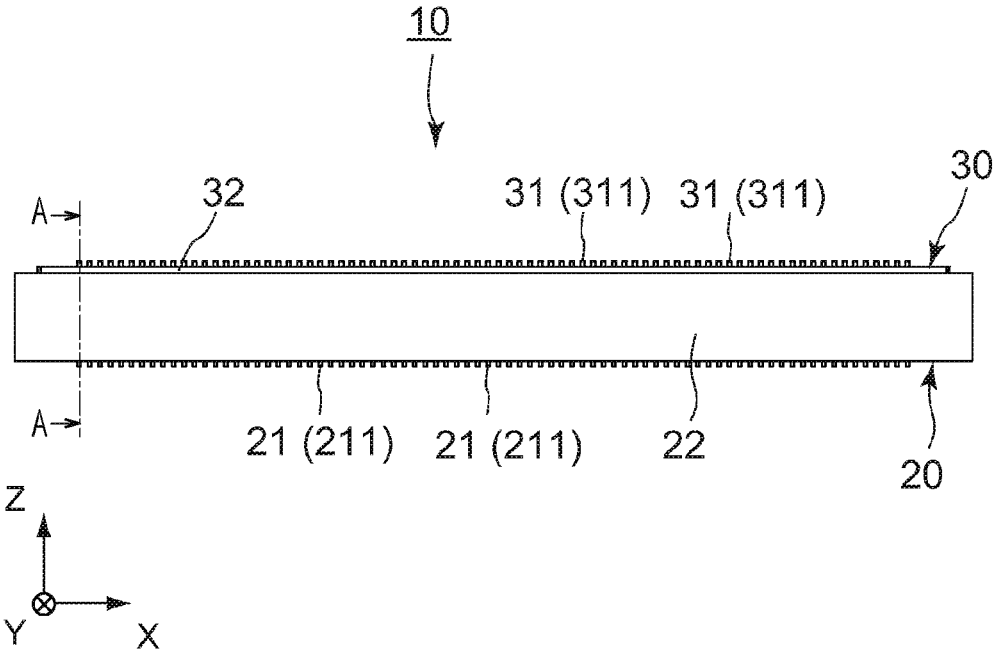
FIG. 3 is a front view of the connector assembly of FIG. 1.
Figure 4:
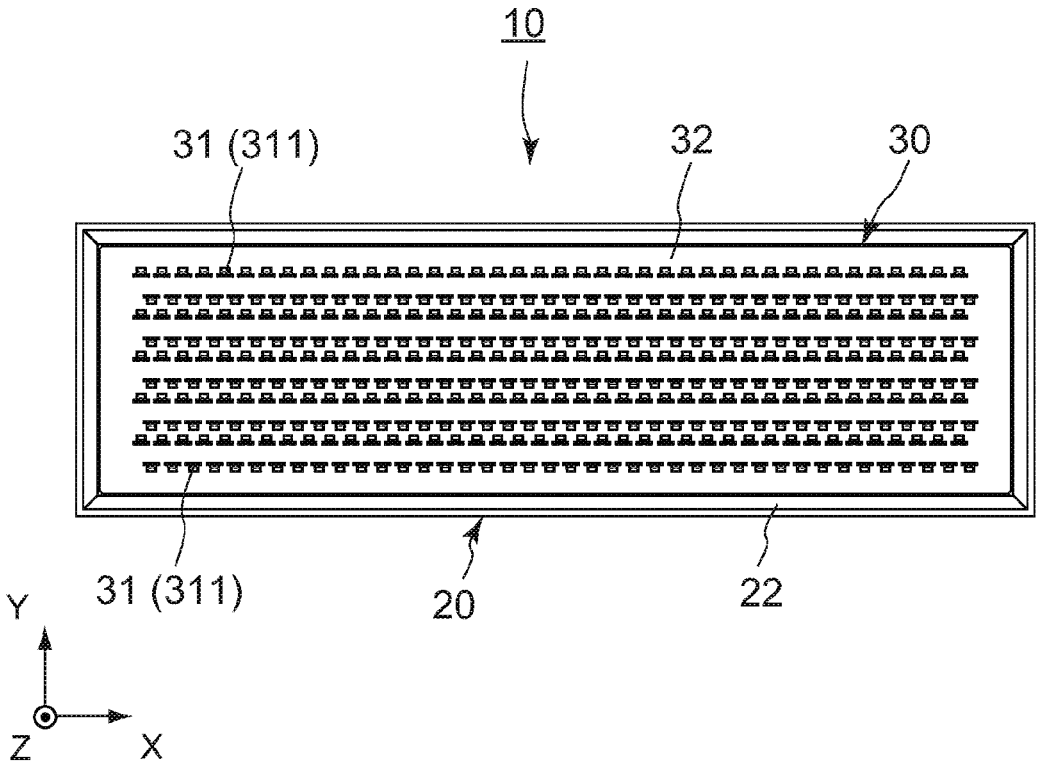
FIG. 4 is a top view of the connector assembly of FIG. 1.
Figure 5:
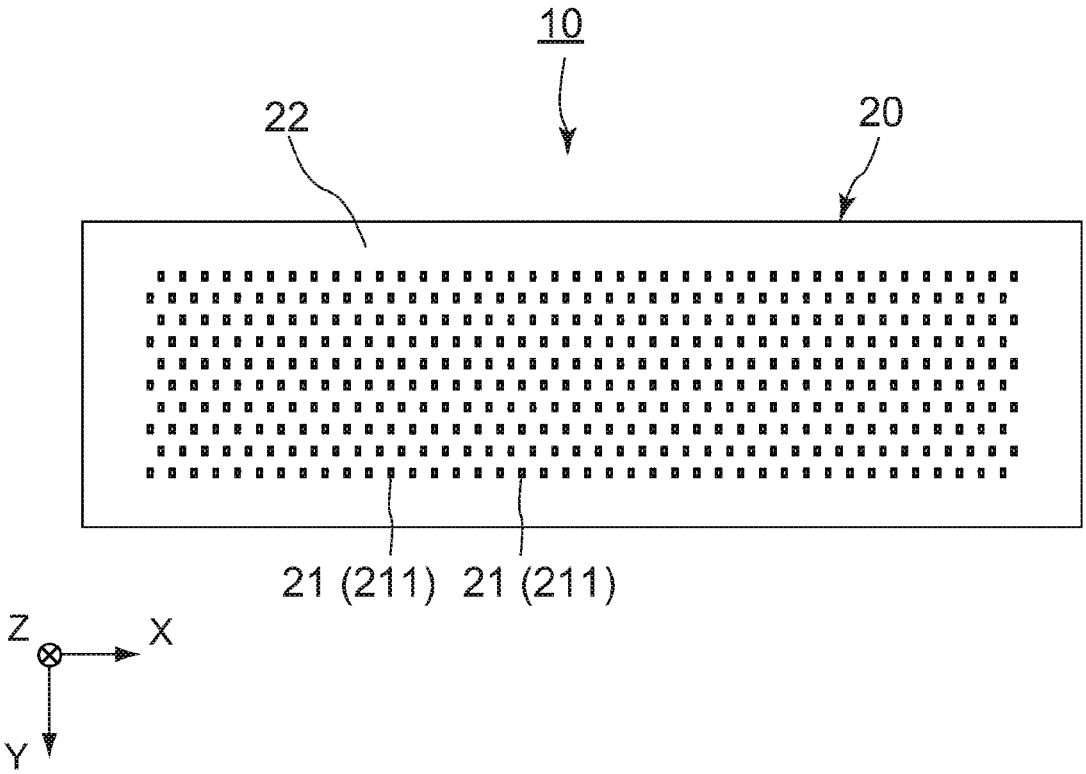
FIG. 5 is a bottom view of the connector assembly of FIG. 1.
Figure 6:
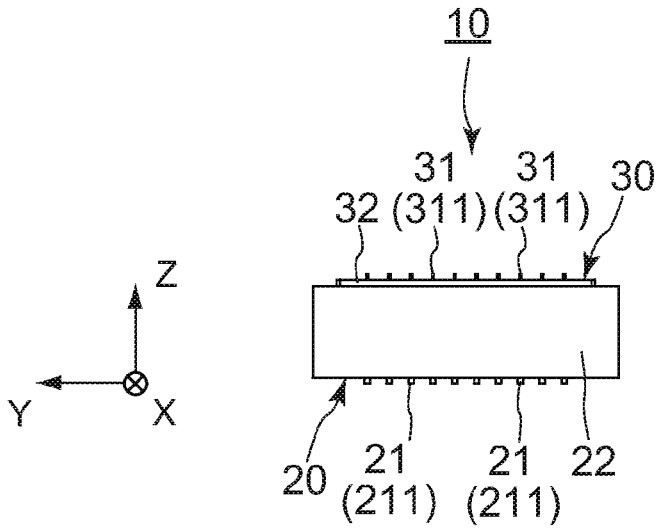
FIG. 6 is a side view of the connector assembly of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIGS. 1 to 6, a connector assembly 10 according to a first embodiment of the present invention has a connector 20 and a mating connector 30. The connector 20 is a socket connector while the mating connector 30 is a pin connector. The connector 20 and the mating connector 30 are mateable with and separable from each other along a height direction or a Z-direction. The connector 20 and the mating connector 30 are mated with each other after upper surfaces of them face each other. In other words, the mating connector 30 is turned upside down in regard to the connector 20 in a mated state. It should be noted that the height direction (or the Z-direction) is a first direction in the present embodiment.

As understood from FIGS. 2, 3, 5 and 6, the connector 20 has a plurality of contacts 21 and a housing 22 holding the contacts. The contacts 21 are formed in the same shape and the same size as each other. The contacts 21 are regularly arranged in two dimensions.

As understood from FIGS. 1, 3, 4 and 6, the mating connector 30 has a plurality of mating contacts 31 and a housing 32 holding the mating contacts 31. The mating contacts 31 correspond to the contacts 21 of the connector 20, respectively. The mating contacts 31 are also formed in the same shape and the same size as each other.

The connector 20 is mounted on a first circuit board (not shown) to be electrically connected with a first circuit (not shown) on the first circuit board, for example. Mounting the connector 20 onto the first circuit board can be achieved, for example, by using solder balls (not shown) provided on connecting terminal portions 211, which are exposed on a surface of the connector 20, of the contacts 21. Alternatively, another surface-mount technology or a through-hole technology may be used.

The mating connector 30 is mounted on a second circuit board (not shown) to be electrically connected with a second circuit (not shown) on the second circuit board, for example. In the same manner as the connector 20, mounting the mating connector 30 onto the second circuit board can be achieved by using solder balls (not shown) provided on connecting terminal portions 311 of the mating contacts 31. Of course, the other surface-mount technology or the through-hole technology may be used.

Such a connector as the connector 20 or the mating connector 30, in which a plurality of connecting terminals are arranged on a surface of a housing and solder balls are provided on the connecting terminals, is referred to as a multipolar connector.

Figure 7:
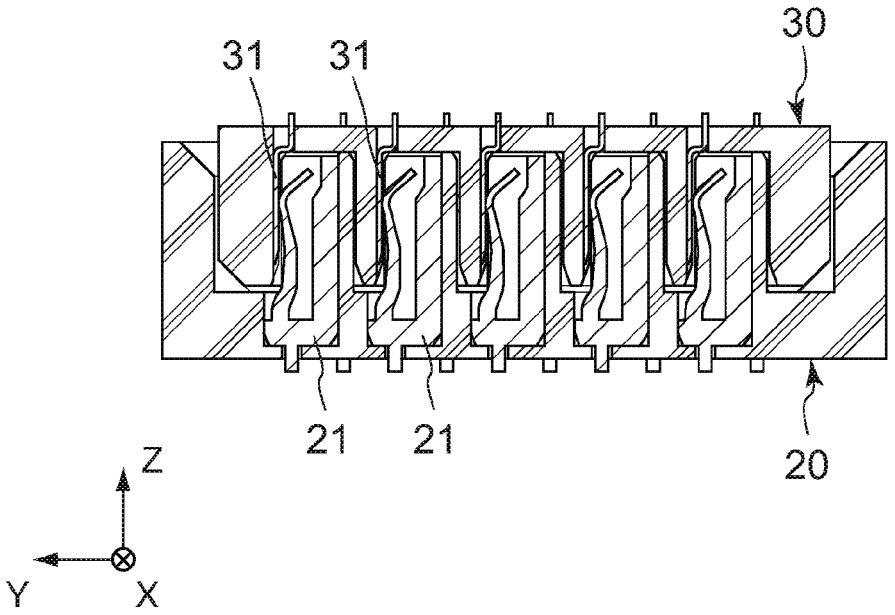
FIG. 7 is a cross-sectional view showing the connector assembly of FIG. 3, taken along A-A line.

As understood from FIG. 7, in the state where the connector 20 and the mating connector 30 are mated with each other, the contacts 21 and the mating contacts 31 come into contact with and are electrically connected with one another. When the connector 20 and the mating connector 30 are mounted on the first circuit board (not shown) and the second circuit board (not shown), respectively, the first circuit board and the second circuit board are fixed to each other by mating the connector 20 with the mating connector 30. Moreover, the first circuit of the first circuit board and the second circuit of the second circuit board are electrically connected with each other.

Referring to FIGS. 8, 11, 13 and 14, the housing 32 of the mating connector 30 has a pair of long wall portions 321 and 322. The long wall portions 321 and 322 extend in a width direction or an X-direction. The long wall portions 321 and 322 have inner wall surfaces 323 and 324, respectively. The inner wall surfaces 323 and 324 are formed to be perpendicular to a depth direction or a Y-direction. The inner wall surfaces 323 and 324, however, do not necessarily have to be perpendicular to the depth direction (or the Y-direction). It should be noted that the X-direction corresponds to a third direction while the Y-direction corresponds to a second direction in the present embodiment.

Figure 8:
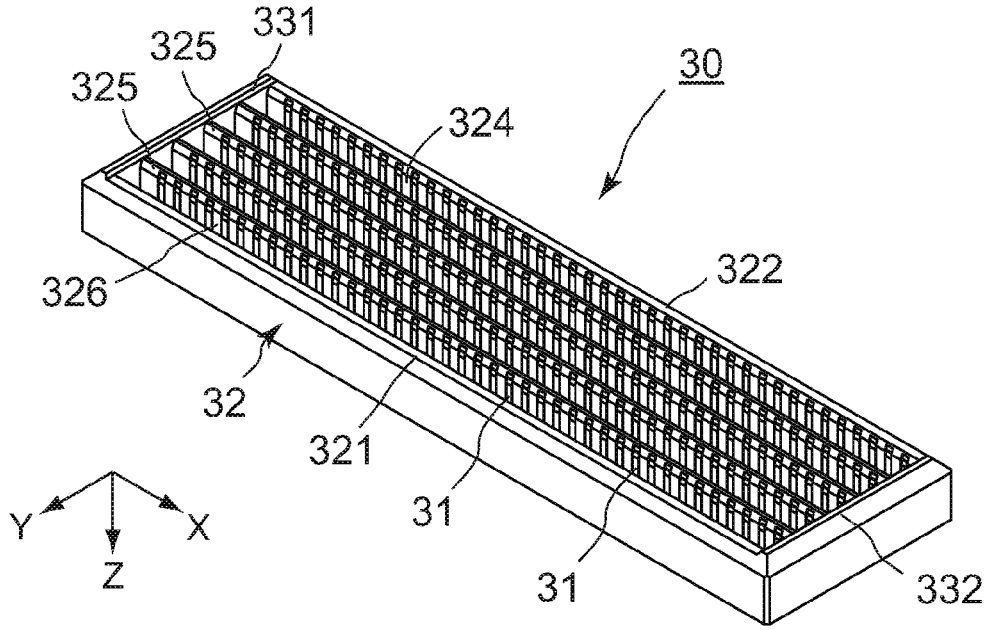
FIG. 8 is a top, perspective view of the mating (or pin) connector used in the connector assembly of FIG. 1.
Figure 9:
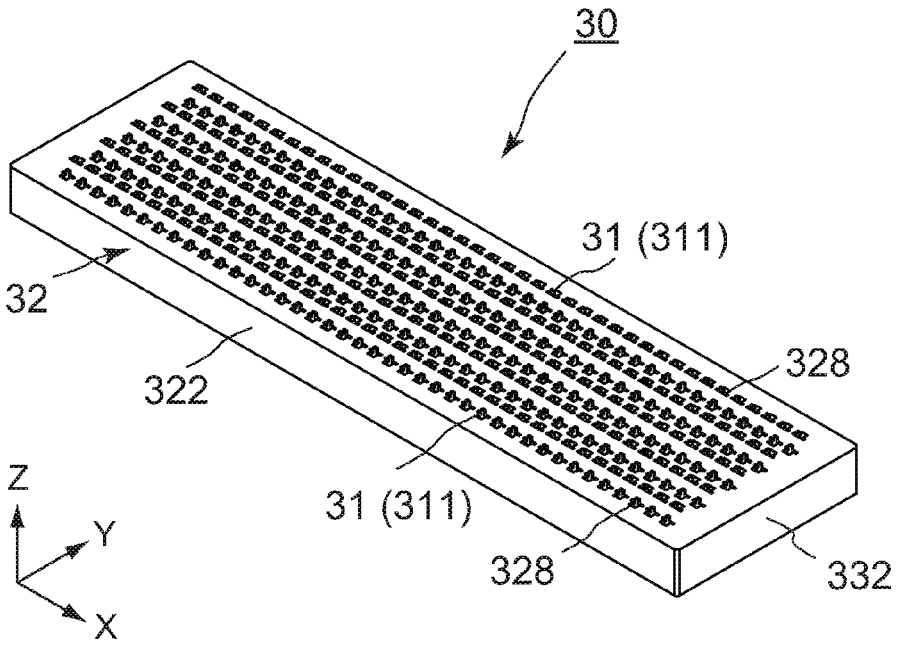
FIG. 9 is a bottom, perspective view of the mating connector of FIG. 8.
Figure 10:
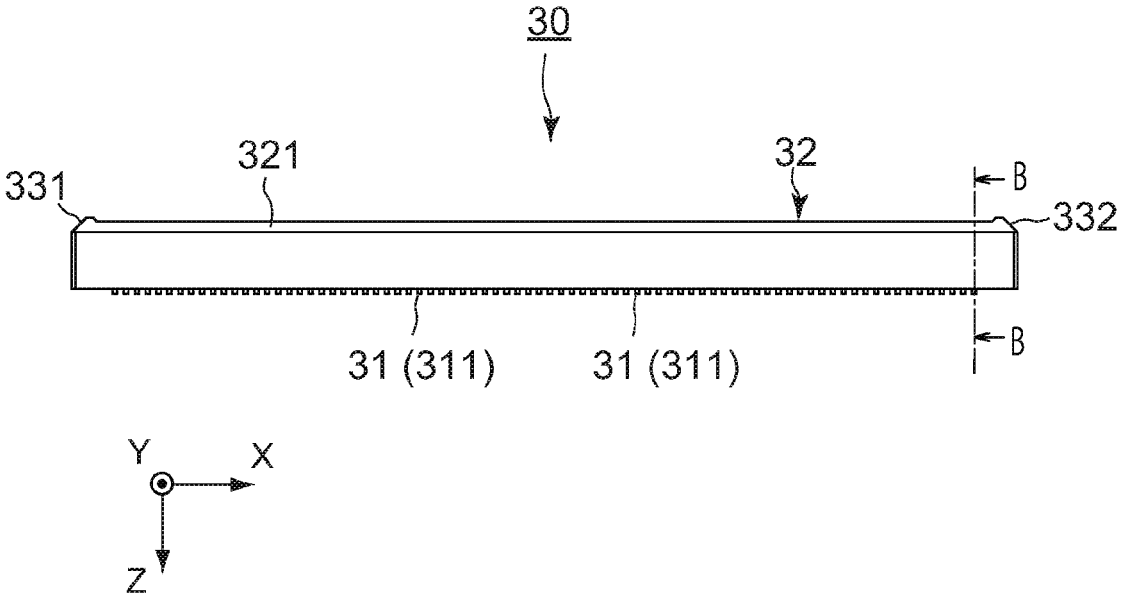
FIG. 10 is a front view of the mating connector of FIG. 8.
Figure 11:
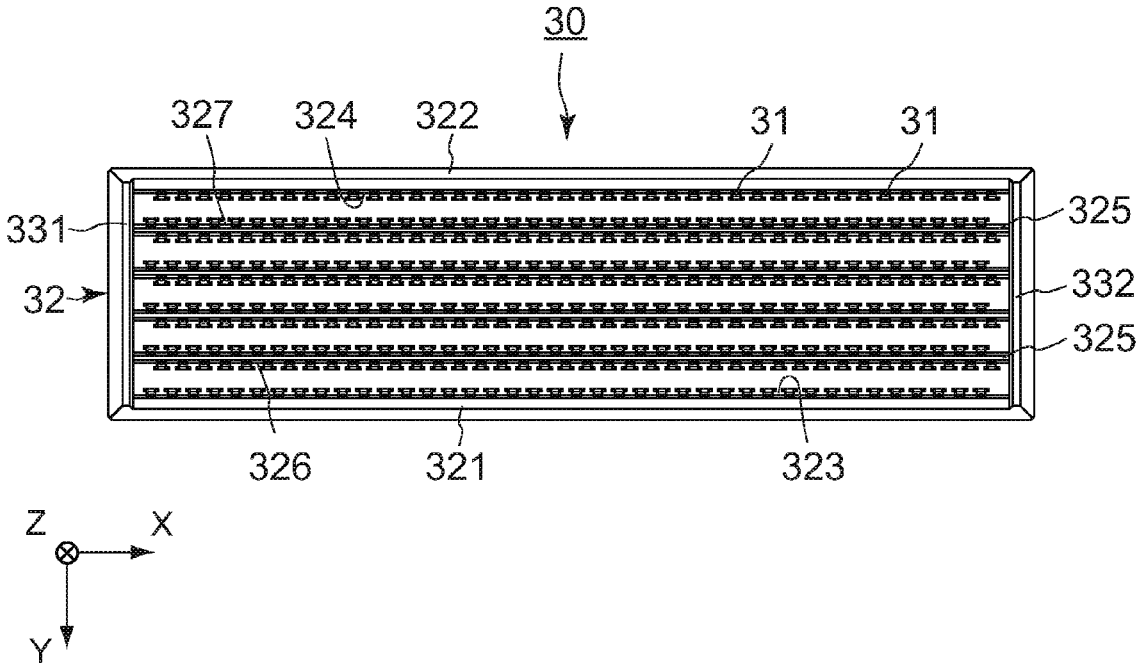
FIG. 11 is a top view of the mating connector of FIG. 8.
Figure 12:
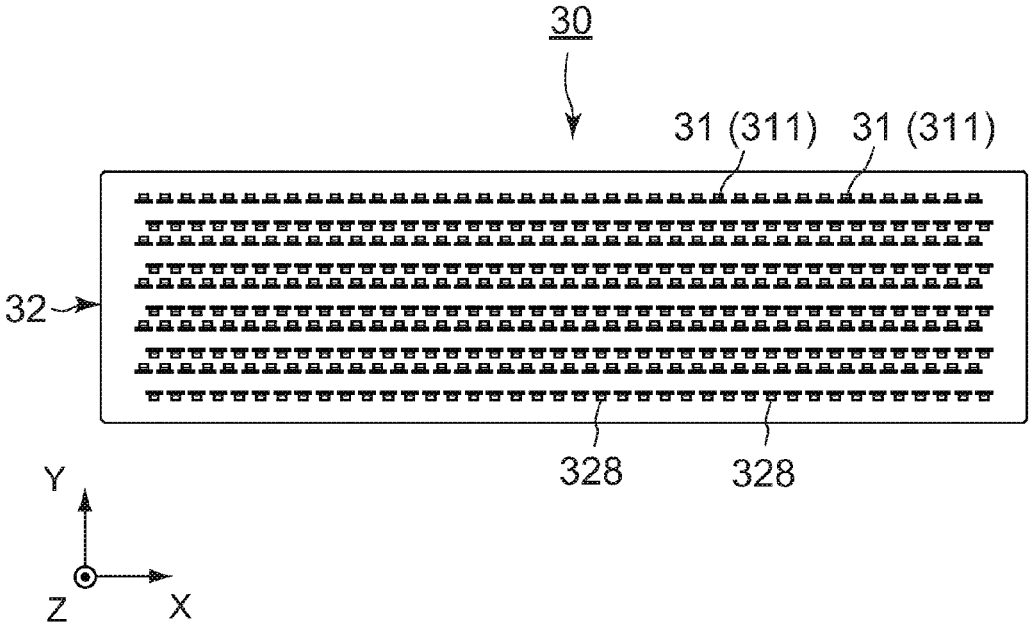
FIG. 12 is a bottom view of the mating connector of FIG. 8.
Figure 13:
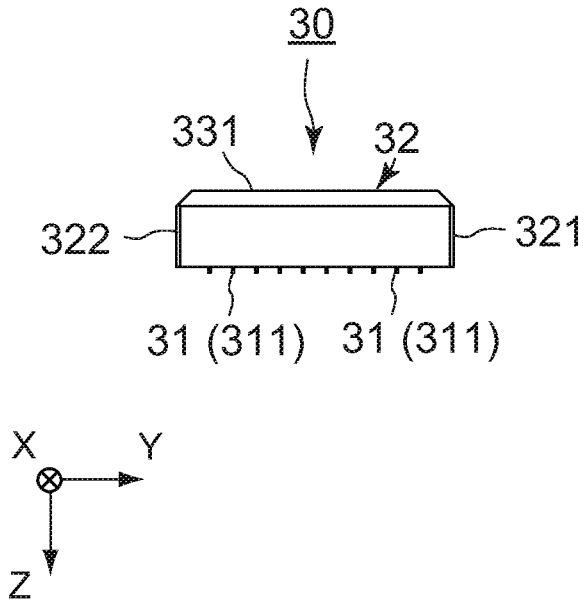
FIG. 13 is a side view of the mating connector of FIG. 8.
Figure 14:
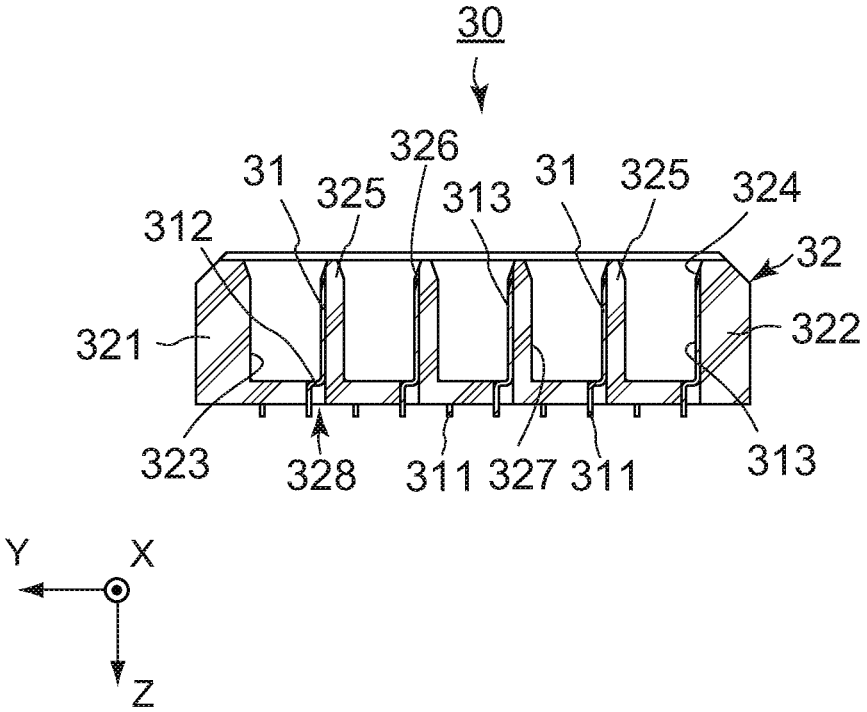
FIG. 14 is a cross-sectional view showing the mating connector of FIG. 10, taken along B-B line.

As understood from FIGS. 8, 11 and 14, the housing 32 further has a plurality (four in this embodiment) of supporting portions 325. The supporting portions 325 extend in the width direction (or the X-direction). The supporting portions 325 are disposed between the pair of the long wall portions 321 and 322 at a predetermined interval in the depth direction (or the Y-direction). The pair of the long wall portions 321 and 322 and the supporting portions 325 are coupled to one another by short wall portions 331 and 332 at their ends in the width direction (or the X-direction).

As understood from FIGS. 8, 11 and 14, each of the supporting portions 325 has a pair of wall surfaces 326 and 327 extending in the width direction (or the X-direction). The pair of the wall surfaces 326 and 327 are perpendicular to the depth direction (or the Y-direction) and parallel to each other. The pair of the wall surfaces 326 and 327, however, may be inclined in the depth direction and not be parallel to each other. The number of the supporting portions 325 is smaller by one than that of holding portions 221, which will be described later, of the connector 20. Accordingly, when the holding portion 221 of the connector 20 is equal to one in number, the mating connector 30 has no supporting portion 325.

As understood from FIGS. 8, 11 and 14, the pair of the long wall portions 321 and 322 and the supporting portions 325 are individually provided with a plurality of the mating contacts 31. The mating contacts 31 are arranged to correspond to the contacts 21 of the connector 20, respectively. Specifically, the mating contacts 31 provided on the wall surface 326 of each of the supporting portions 325 and the mating contacts 31 provided on the wall surface 327 of the supporting portion 325 are alternately arranged in the width direction (or the X-direction). The mating contacts 31 provided on the inner wall surface 323 of the long wall portion 321 and the mating contacts 31 provided on the wall surface 326 of the supporting portion 325 opposed to the long wall portion 321 are alternately arranged in the width direction (or the X-direction). Similarly, the mating contacts 31 provided on the inner wall surface 324 of the long wall portion 322 and the mating contacts 31 provided on the wall surface 327 of the supporting portion 325 opposed to the long wall portion 322 are alternately arranged in the width direction (or the X-direction).

Figure 15:
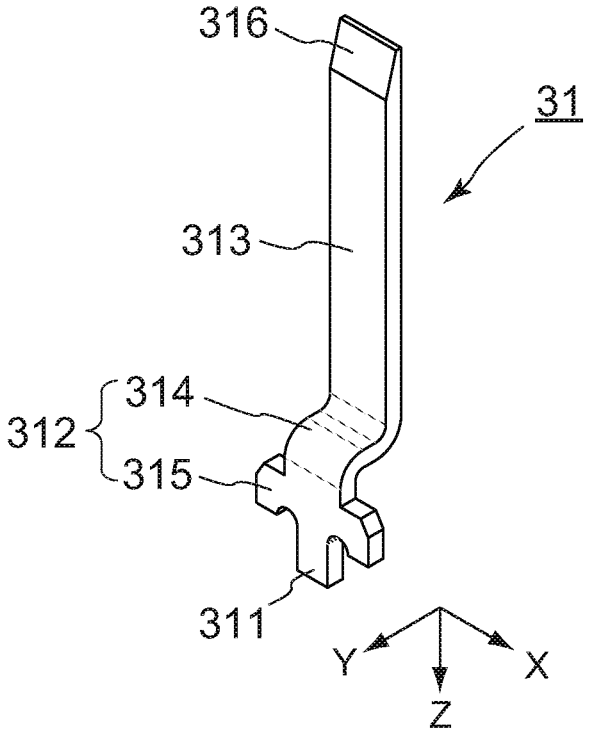
FIG. 15 is a perspective view of a contact which is included in the mating connector of FIG. 8 and provided on one of a pair of wall surfaces of a supporting portion.
Figure 16:
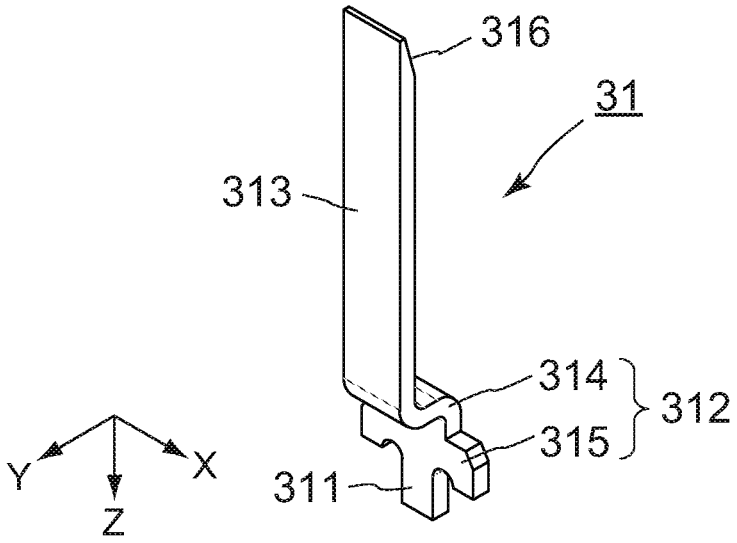
FIG. 16 is a perspective view of a contact which is included in the mating connector of FIG. 8 and provided on the other of the pair of the wall surfaces of the supporting portion.
Figure 17:
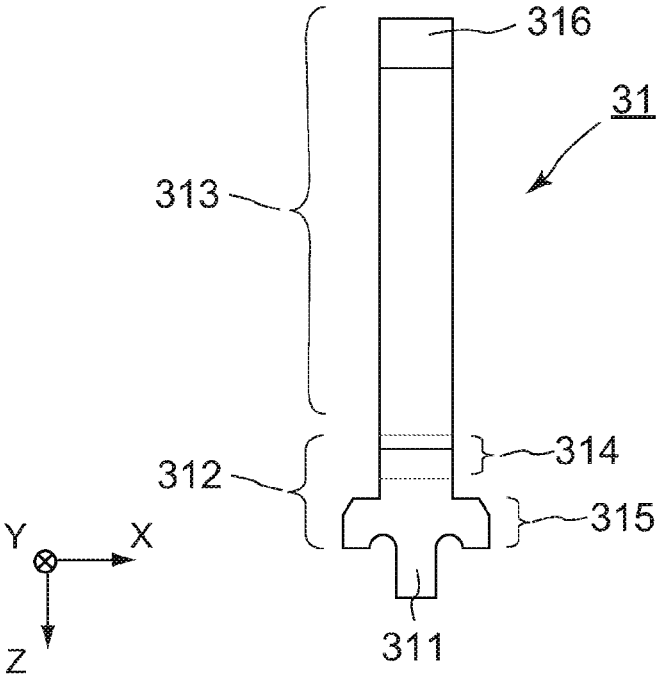
FIG. 17 is a front view of the contact of FIG. 15.

As shown in FIGS. 15 to 17, the mating contact 31 has the connecting terminal portion 311, a fixed portion 312 and a contact portion 313. The mating contact 31 is formed by punching out a metal sheet and subsequently bending the punched out metal sheet, for example.

As understood from FIGS. 15 to 17, the fixed portion 312 includes a folded portion 314 and a wide portion 315. The wide portion 315 has a larger size than those of the contact portion 313 and the folded portion 314 in the width direction (or the X-direction). In other words, the wide portion 315 is larger than both of the contact portion 313 and the folded portion 314 in width. The folded portion 314 functions to push the contact portion 313 toward any one of the inner wall surfaces 323 and 324 of the long wall portions 321 and 322 and the wall surfaces 326 and 327 of the supporting portions 325. The inner wall surfaces 323 and 324 and the wall surfaces 326 and 327 are formed with a plurality of channels for receiving the contact portions 313. The contact portion 313 is received by the channel corresponding thereto. The contact portion 313 received by the channel comes into surface contact with an inner surface of the channel by function of the folded portion 314. The wide portion 315 stabilizes fixing of the fixed portion 312 against the housing 32 in the width direction (or the X-direction).

As shown in FIGS. 15 to 17, the contact portion 313 is formed in a tapered shape at a tip portion 316 thereof. The tapered shape of the tip portion 316 is for facilitating that the contact 21 of the connector 20 receives the mating contact 31. A part of the contact portion 313 serves as a contact point which comes into contact with the contact 21 of the connector 20.

As understood from FIG. 14, the fixed portion 312 is press-fit into a holding hole 328 to be fixed to the housing 32. As shown in FIGS. 9, 10, 12 and 14, a part of the connecting terminal portion 311 protrudes outward from a surface (or a bottom face) of the housing 32 in the height direction (or the Z-direction). As understood from FIGS. 8, 11 and 14, the contact portion 313 extends in the height direction (or the Z-direction) along any one of the long wall portions 321 and 322, the inner wall surfaces 323 and 324, and the pair of the wall surfaces 326 and 327 of the supporting portions 325. The direction the connecting terminal portion 311 protrudes and the direction the contact portion 313 extends are opposite to each other. It should be noted that a direction of front faces of the mating contacts 31 is a leftward direction along the depth direction (or the Y-direction) in FIG. 14. Furthermore, a direction of front faces of the mating contacts 31 provided on the inner wall surface 323 of the long wall portion 321 is opposite to the direction of the front faces of the mating contacts 31 provided on the inner wall surface 324 of the long wall portion 322 in the depth direction (or the Y-direction). In addition, a direction of front faces of the mating contacts 31 provided on the wall surfaces 327 of the supporting portions 325 is opposite to the direction of the front faces of the mating contacts 31 provided on the wall surfaces 326 of the supporting portions 325 in the depth direction (or the Y-direction). Thus, the front faces of the mating contacts 31 provided on the inner wall surface 323 of the long wall portion 321 are directed in the direction of a rear face of the housing 32 while the front faces of the mating contacts 31 provided on the inner wall surface 324 of the long wall portion 322 are directed in the direction of a front face of the housing 32. The front faces of the mating contacts 31 provided on the wall surface 326 of each of the supporting portions 325 are directed in the direction of the front face of the housing 32 while the front faces of the mating contacts 31 provided on the wall surface 327 of each of the supporting portions 325 are directed in the direction of the front face of the housing 32.

Figure 18:
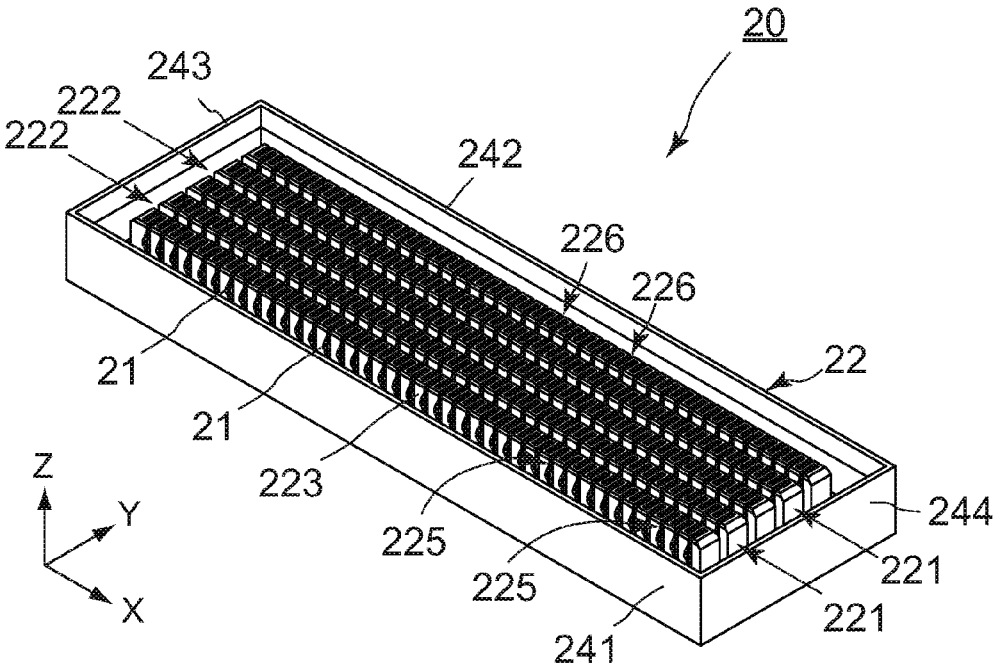
FIG. 18 is a top, perspective view of the (socket) connector used in the connector assembly of FIG. 1.
Figure 19:
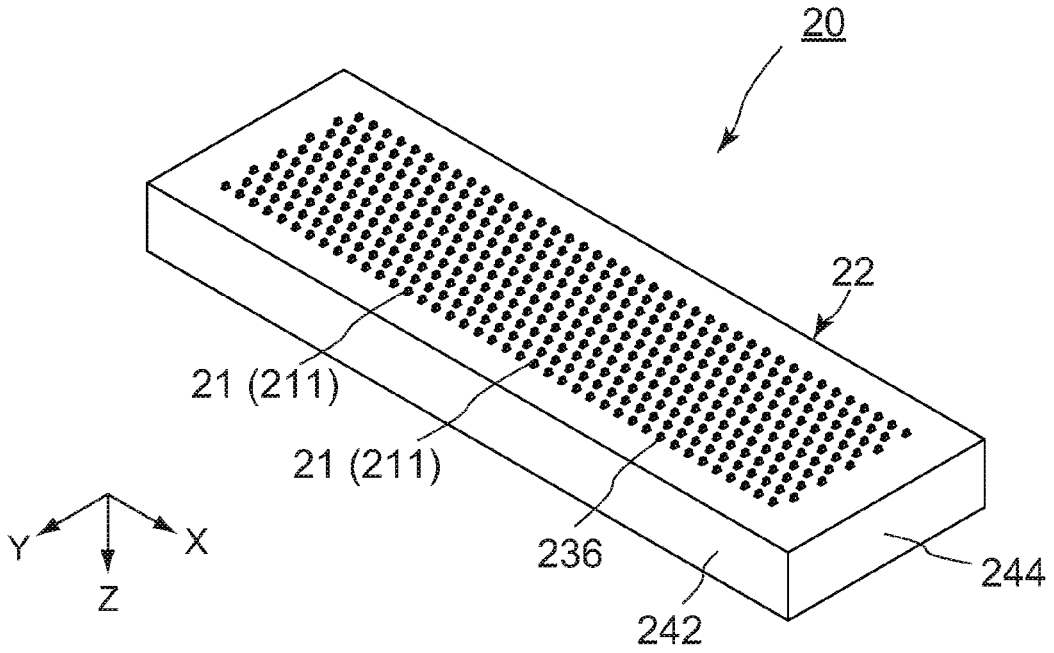
FIG. 19 is a bottom, perspective view of the connector of FIG. 18.
Figure 20:
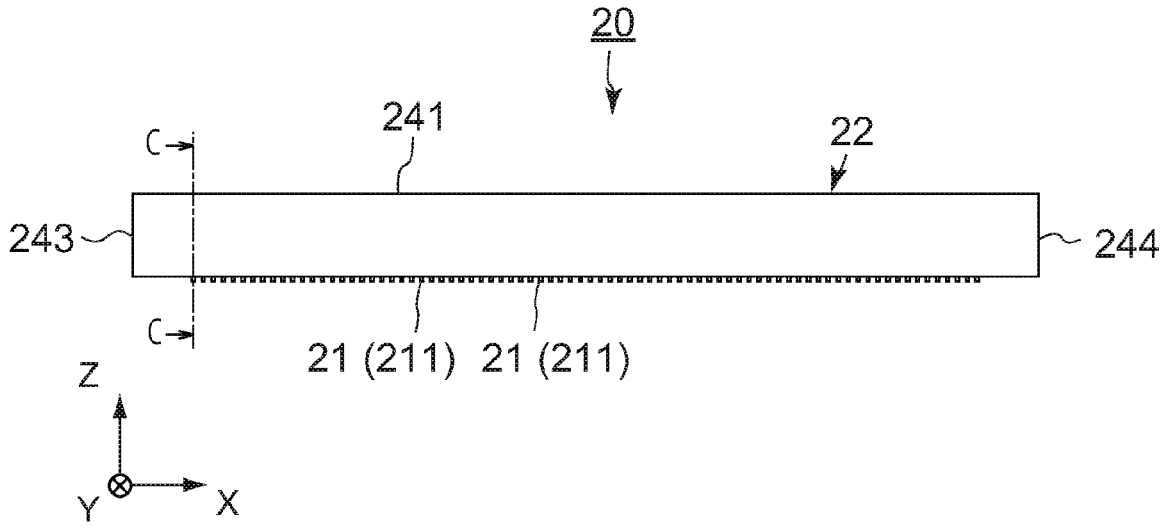
FIG. 20 is a front view of the connector of FIG. 18.
Figure 21:
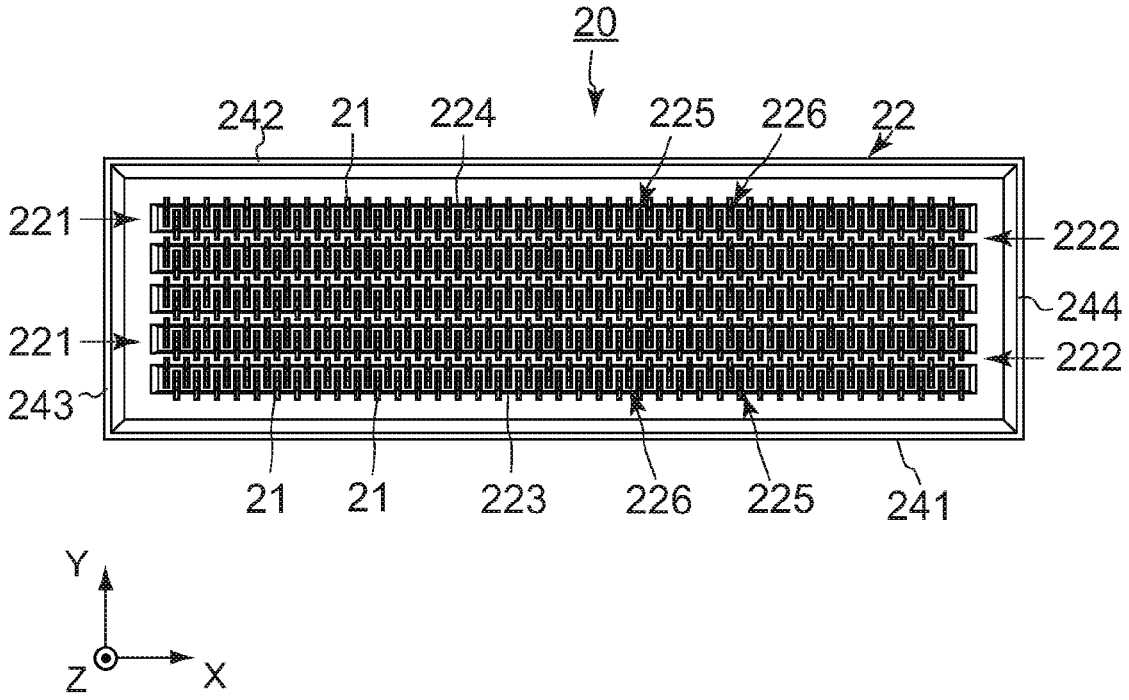
FIG. 21 is a top view of the connector of FIG. 18.
Figure 22:
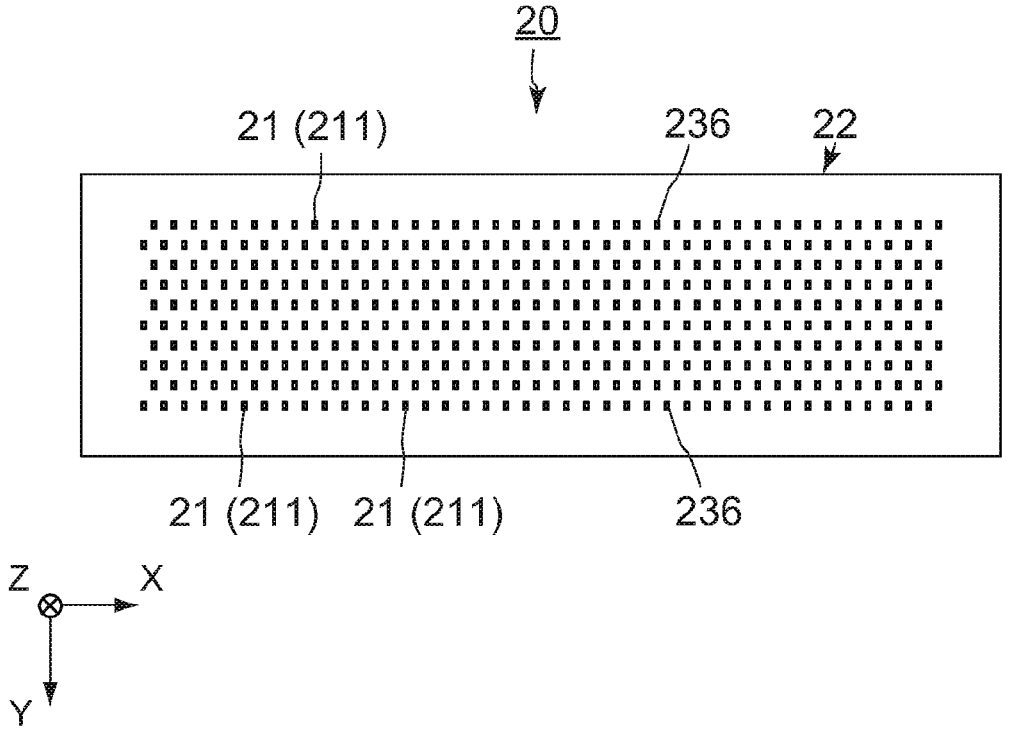
FIG. 22 is a bottom view of the connector of FIG. 18.
Figure 23:
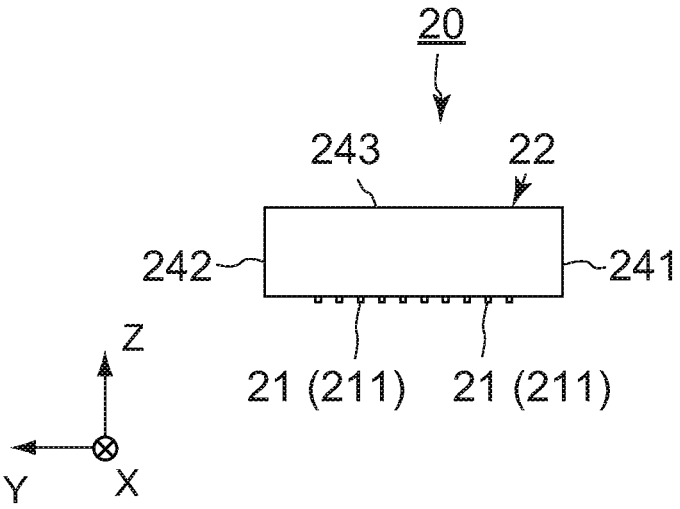
FIG. 23 is a side view of the connector of FIG. 18.
Figure 24:
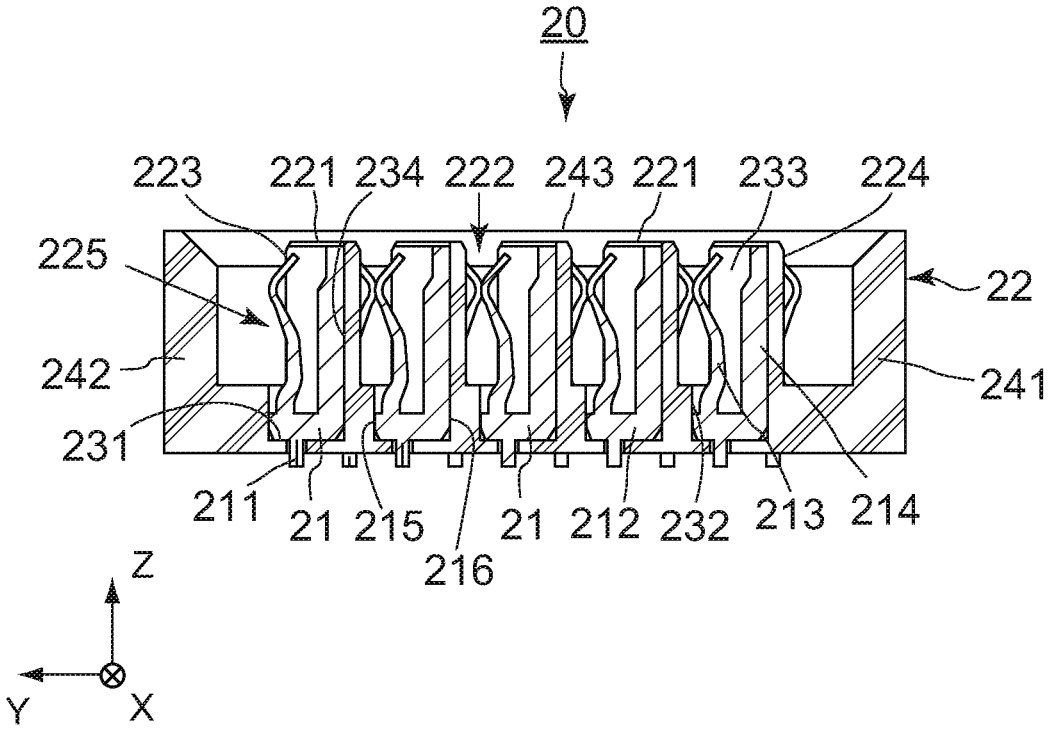
FIG. 24 is a cross-sectional view showing the connector of FIG. 20, taken along C-C line.

Referring to FIGS. 18, 21 and 24, the housing 22 of the connector 20 has a pair of long wall portions 241 and 242 and a pair of short wall portions 243 and 244. The housing 22 further has one or more (five in the present embodiment) holding portions 221. The holding portions 221 are surrounded by the pair of the long wall portions 241 and 242 and the pair of the short wall portions 243 and 244. Each of the holding portions 221 is formed to extend in the width direction (or the X-direction). When the holding portions 221 are equal to two or more in number, they are arranged in parallel with each other at intervals in the depth direction (or the Y-direction). Between every adjacent two of the holding portions 221, a slot 222 is formed. The slots 222 correspond to the supporting portions 325 of the mating connector 30.

As understood from FIGS. 18, 21 and 24, each of holding portions 221 has a pair of wall surfaces 223 and 224 arranged in or perpendicular to the depth direction (or the Y-direction). As understood from FIGS. 24, 25 and 27, each of the holding portions 221 further has a plurality of holding grooves, i.e. a plurality of first holding grooves 225 and a plurality of second holding grooves 226. The first and the second holding grooves 225 and 226 accommodate the contacts 21 individually. In each of the holding portions 221, the first holding grooves 225 and the second holding grooves 226 are alternately arranged at regular intervals in the width direction (or the X-direction). The first holding grooves 225 have opening portions opening at one of the wall surfaces, i.e. the wall surface 223, of the holding portion 221 corresponding thereto while the second holding grooves 226 have opening portions opening at the other of the wall surfaces, i.e. the wall surface 224, of the holding portion 221 corresponding thereto.

Figure 25:
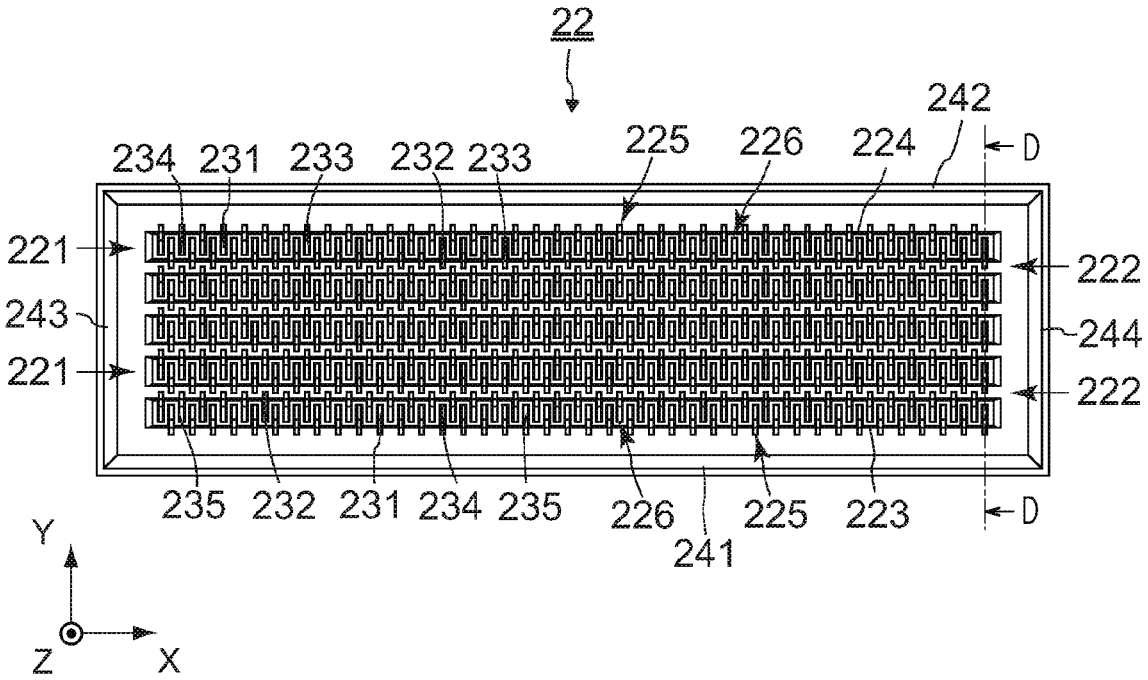
FIG. 25 is a top view of the housing included in the connector of FIG. 18.
Figure 26:
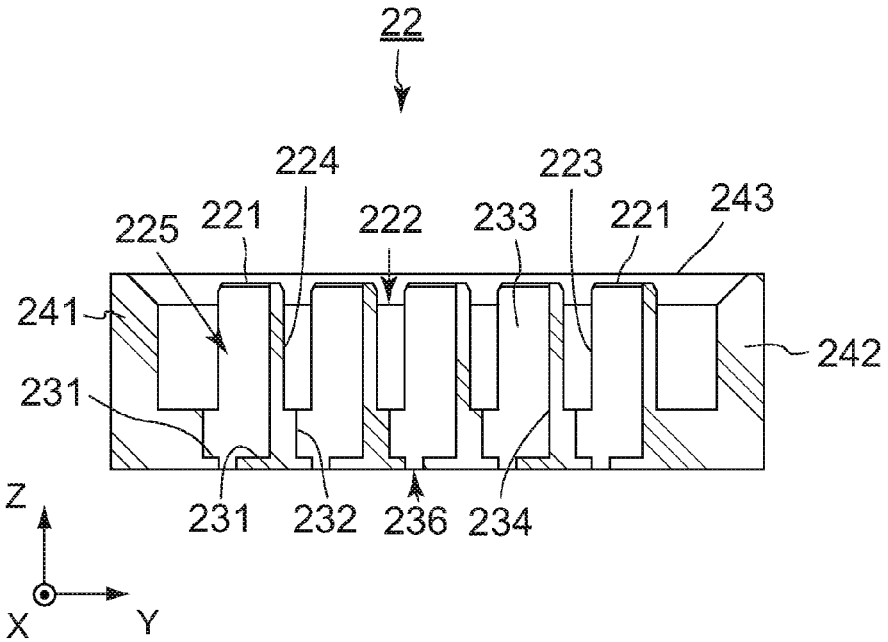
FIG. 26 is a cross-sectional view showing the housing of FIG. 25, taken along D-D line.
Figure 27:
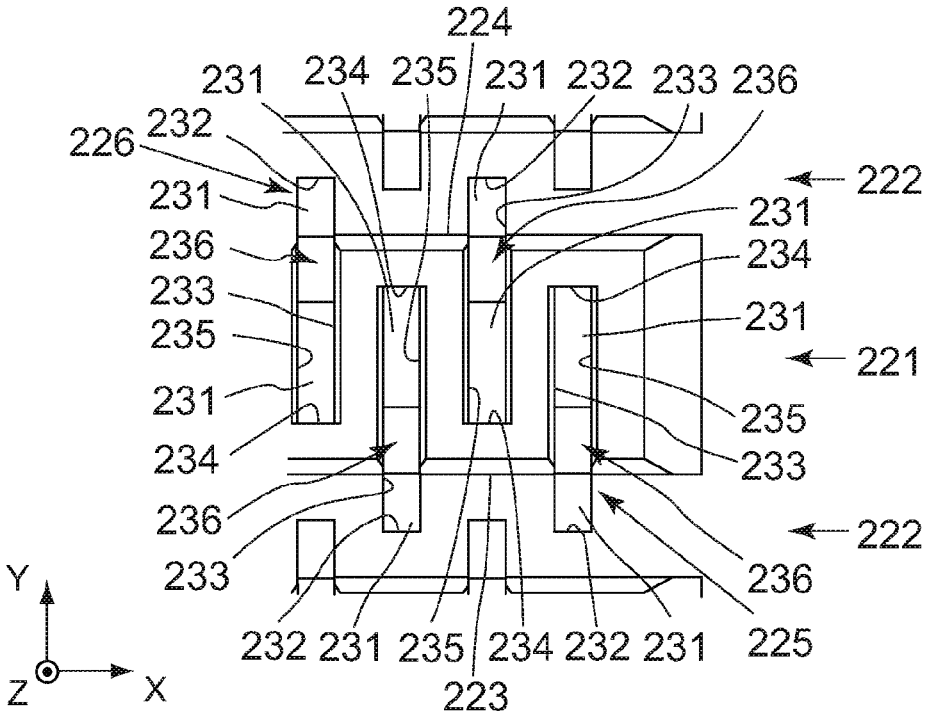
FIG. 27 is an enlarged view showing a part of the housing of FIG. 25.

As understood from FIGS. 25 to 27, the first holding grooves 225 and the second holding grooves 226 have the same structure and the same size as each other although they have different directions. Specifically, each of the first and the second holding grooves 225 and 226 has a bottom face 231 and four inner walls 232-235 extending from the bottom face 231 in the height direction (or the Z-direction). In the bottom face 231, a through hole 236 is formed. It should be noted that the first and the second holding grooves 225 and 226 do not necessarily have to have the bottom face 231. Particularly, the bottom face 231 does not exist in a case where the first and the second holding grooves 225 and 226 are formed to receive the contacts 21 from a bottom face of the housing 22.

Figure 28:
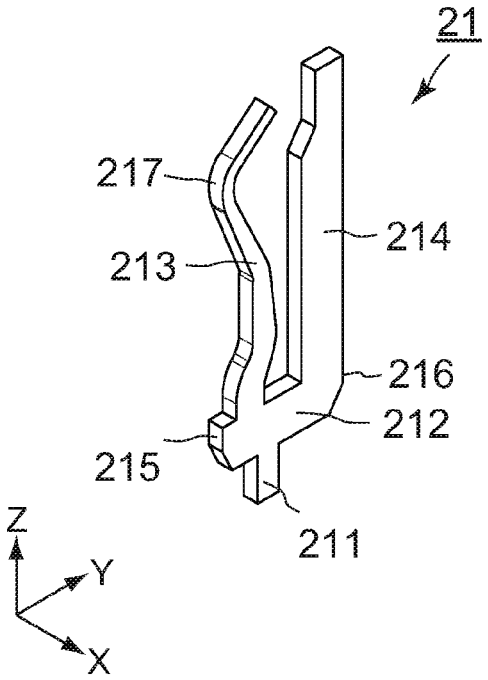
FIG. 28 is a perspective view of a contact which is included in the connector of FIG. 18 and accommodated in a first holding groove.
Figure 29:
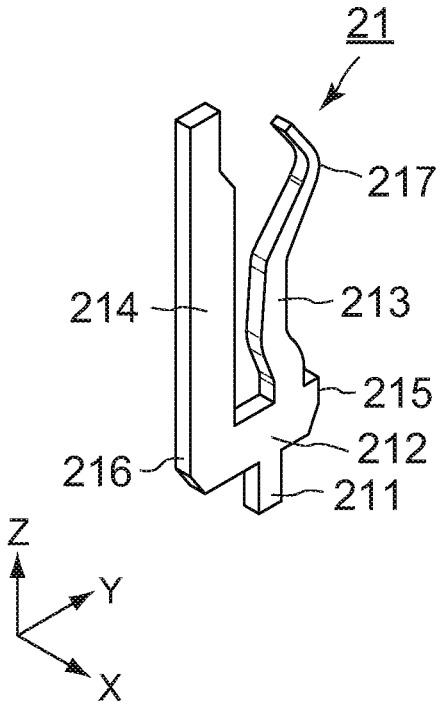
FIG. 29 is a perspective view of a contact which is included in the connector of FIG. 18 and accommodated in a second holding groove.
Figure 30:
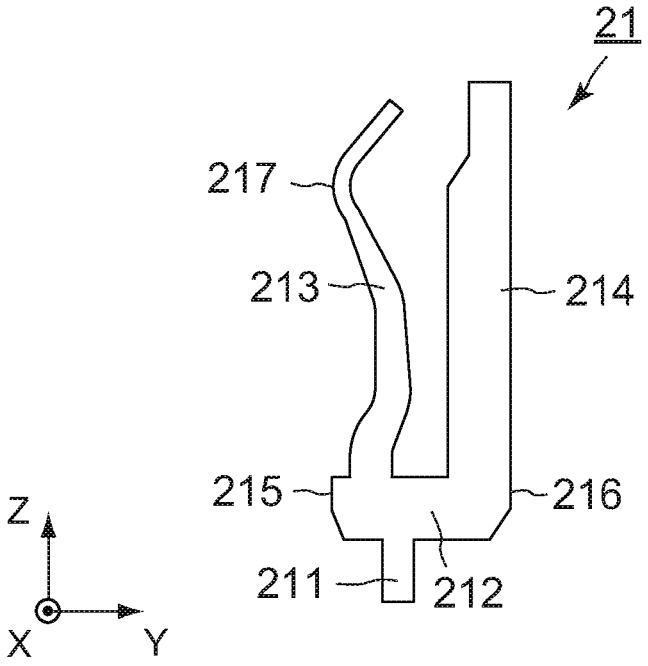
FIG. 30 is a side view of the contact of FIG. 28.

As shown in FIGS. 28 to 30, the contact 21 has a connecting terminal portion 211, a fixed portion 212, a contact arm portion 213 and a support arm portion 214. The contact 21 can be formed, for example, by punching out a metal sheet. When it is assumed that the metal sheet has a pair of main surfaces parallel to both of the depth direction (or the Y-direction) and the height direction (or the Z-direction), the contact 21 is punched out in the width direction (or the X-direction). In this case, the pair of the main surfaces of the metal sheet form a pair of side faces of the contact 21 in the width direction (or the X-direction). The contact 21 formed as aforementioned has a uniform width equal to a thickness of the metal sheet. In the present embodiment, the contact 21 is not subjected to deformation processing such as providing protrusions. Moreover, the contact 21 is not subjected to bending processing to give a desired shape to the contact arm portion 213.

As understood from FIGS. 28 to 30, the connecting terminal portion 211 protrudes from the fixed portion 212 in the height direction (or the Z-direction). The connecting terminal portion 211 is provided at a position biased on one side from a middle of the fixed portion 212 in the depth direction (or the Y-direction). As understood from FIG. 24, when each of the contacts 21 is accommodated in a corresponding one of the first and the second holding grooves 225 and 226, the fixed portion 212 is positioned at a side of the bottom face 231 of the corresponding one of the first and the second holding grooves 225 and 226. A direction of a front face of the contact 21 is a leftward direction along the depth direction (or the Y-direction) in FIG. 30. A direction of front faces of the contacts 21 accommodated in the first holding grooves 225 and a direction of front faces of the contacts 21 accommodated in the second holding grooves 226 are opposite to each other in the depth direction (or the Y-direction). In other words, the front faces of the contacts 21 accommodated in the first holding grooves 225 are directed in the direction of a front face of the housing 22 while the front faces of the contacts 21 accommodated in the second holding grooves 226 are directed in the direction of a rear face of the housing 22.

As understood from FIGS. 18, 21 and 24, each of the contacts 21 is accommodated in the corresponding one of the first and the second holding grooves 225 and 226. In such a state, the connecting terminal portion 211 of the contact 21 has a height such that at least a part thereof protrudes from a surface (or a bottom face) of the housing 22, as shown in FIGS. 19, 20, 22 to 24. The connecting terminal portions 211 of adjacent two of the contacts 21 in the width direction (or the X-direction) are placed apart from each other in depth direction (or the Y-direction). This allows that an interval between the connecting terminal portions 211 of the adjacent two of the contacts 21 is larger than the shortest interval between the contacts 21, as understood from FIGS. 19 and 22. In other words, the interval between the adjacent two of the connecting terminal portions 211 can be larger than the shortest interval between the adjacent two of the contacts 21. Accordingly, the interval between the adjacent two of the contacts 21 can be reduced while a short circuit between them is prevented. Thus, the connector 20 can be downsized.

Referring to FIGS. 28 to 30 again, the fixed portion 212 has a pair of end faces 215 and 216 in the depth direction (or the Y-direction). As understood from FIG. 24, an interval between the end faces 215 and 216, or a depth of the fixed portion 212, is slightly longer than a depth of each of the first and the second holding grooves 225 and 226. Consequently, the fixed portion 212 is fixed to the housing 22 by press-fitting the contact 21 into the corresponding one of the first and the second holding grooves 225 and 226. In other words, the end faces 215 and 216 of the fixed portion 212 in the depth direction (or the Y-direction) come into surface contact with the inner walls 232 and 234, respectively, of either the first holding groove 225 or the second holding groove 226, and the fixed portion 212 is fixed to the housing 22.

Fixing method for the fixed portion 212 is not limited to aforementioned fixing method. For example, the end faces 215 and 216 of the fixed portion 212 may have protrusions formed thereon so that the protrusions come into point contact with the inner walls 232 and 234, respectively, of either the first holding groove 225 or the second holding groove 226. Alternatively, adhesive may be also used. In addition, the fixed portion 212 may have one or more protrusion portions formed thereon to protrude in the width direction (or the X-direction) so that the protrusion portions are pressed against at least one of the inner walls 233 and 235 of either the first holding groove 225 or the second holding groove 226. Against resilient deformation of the contact arm portion 213 described later, the fixing method using the end faces 215 and 216 of the fixed portion 212 in the depth direction (or the Y-direction) makes (the fixation of) the fixed portion 212 stable in comparison with the fixing method using the protrusion portion in the width direction (or the X-direction).

Referring to FIGS. 28 to 30 again, the contact arm portion 213 and the support arm portion 214 extend from the fixed portion 212, individually, in height direction (or the Z-direction). The contact arm portion 213 and the support arm portion 214 extend in a direction opposite to an extending direction of the connecting terminal portion 211. The contact arm portion 213 and the support arm portion 214 are roughly equal to each other in height. The contact arm portion 213 and the support arm portion 214 are roughly disposed in parallel to each other. In other words, the contact arm portion 213 and the support arm portion 214 are disposed in the depth direction (or the Y-direction) at an interval to be opposed to each other via a space. In other words, the contact arm portion 213 faces the support arm portion 214. As understood from FIGS. 24 and 27, there is no member between the contact arm portion 213 and the support arm portion 214 even when the contact 21 is accommodated in the corresponding one of the first and the second holding grooves 225 and 226. That is, in such a state, the contact arm portion 213 and the support arm portion 214 are opposed to or face each other via the space.

As understood from FIGS. 28 to 30, the contact arm portion 213 is placed apart from the end face 215 of the fixed portion 212. In other words, the fixed portion 212 protrudes in the depth direction (or the Y-direction) in comparison with the contact arm portion 213. As understood from FIGS. 24 and 27, this structure can reduce a contact area between the contact 21 and the housing 22 when the contact 21 is accommodated in either the first holding groove 225 or the second holding groove 226. Accordingly, the contact 21 can be easily press-fit into the first holding groove 225 or the second holding groove 226. In addition, the contact arm portion 213 is prevented from coming into contact with the housing 22 and breaking when press-fitting of the contact 21.

The contact arm portion 213 is resiliently deformable so that its tip comes close to the support arm portion 214. For this, the contact arm portion 213 is formed to be supple at least in the depth direction (or the Y-direction). That is, the contact arm portion 213 has a shape and a size for allowing resilient deformation at least in the depth direction (or the Y-direction). The contact arm portion 213 has a depth gradually reduced toward its tip in the present embodiment.

As shown in FIGS. 28 to 30, the contact arm portion 213 has a contact point 217 to come into contact with the mating contact 31. The contact point 217 is movable in the depth direction (or the Y-direction) mainly owing to resilient deformation of the contact arm portion 213. In other words, the contact arm portion 213 is resiliently deformable so that the contact point 217 comes close to the support arm portion 214.

As understood from FIGS. 28 to 30, the contact arm portion 213 further has a curved shape like S. Especially, a tip portion of the contact arm portion 213 is bent toward the support arm portion 214 to receive the mating contact 31 smoothly. The shape allows that the contact arm portion 213 receives the mating contact 31 smoothly. The shape further allows that the contact point 217 comes into contact with the mating contact 31 favorably. In addition, reaction force is generated due to resilient deformation of the contact arm portion 213 and efficiently functions to press the contact point 217 against the mating contact 31.

On the other hand, the support arm portion 214 has a surface on the same plane as the end face 216 of the fixed portion 212. In other words, the support arm portion 214 has an end portion continuing linearly to an end portion of the fixed portion 212. The support arm portion 214 further has a size larger than that of the contact arm portion 213 in the depth direction (or the Y-direction). A depth of the support arm portion 214 is designed so that the support arm portion 214 is not deformed by force enough to resiliently deform the contact arm portion 213. The depth of the support arm portion 214 is further designed not to prevent the contact arm portion 213 from being resiliently deformed. The depth of a tip portion of the support arm portion 214 is smaller than that of the other portion located near the fixed portion 212 in the present embodiment.

As understood from FIGS. 7 and 24, when the connector 20 and the mating connector 30 are in the middle of mating or mated with each other, the contact arm portion 213 receives force from the mating contact 31 to move the tip of the contact arm portion 213 toward the support arm portion 214. At this time, the fixed portion 212 of the contact 21 is fixed to the housing 22. Accordingly, the moment having a direction from the contact arm portion 213 to the support arm portion 214 is produced on the contact 21. The support arm portion 214 abuts on the inner wall 234 of either the first holding groove 225 or the second holding groove 226 to prevent or suppress a turn of the contact 21 against the moment. If the support arm portion 214 abuts on the inner wall 234 in a state where the connector 20 and the mating connector 30 are not mated with each other yet, the contact 21 can be prevented from being rotated when the moment is produced on the contact 21 by the mating. Even if there is a space between the support arm portion 214 and the inner wall 234 in the state where the connector 20 and the mating connector 30 are not mated with each other yet, the contact 21 can be prevented from being rotated after the support arm portion 214 is turned to abut on the inner wall 234. In other words, the turn amount of the contact 21 can be suppressed to an amount corresponding to the space between the support arm portion 214 and the inner wall 234 in the unmated state.

In the present invention, the first and the second holding grooves 225 and 226 have bottom faces 231, individually. The fixed portion 212 also serves to prevent or suppress the turn of the contact 21 when the fixed portion 212 abuts on the bottom face 231. Even when there is a space between the fixed portion 212 and the bottom face 231, the turn of the contact 21 can be prevented after the fixed portion 212 is turned and abuts on the bottom face 231. Thus, when the first and the second holding grooves 225 and 226 have the bottom faces 231, individually, the fixed portion 212 also serves to prevent the turn of the contact 21 in addition to the support arm portion 214. Even if the first and the second holding grooves 225 and 226 do not have the bottom faces 231, the turn of the contact 21 can be prevented or suppressed sufficiently by the support arm portion 214.

As mentioned above, the connector 20 according to the present embodiment is provided with the plurality of the contacts 21 and the housing 22 having the plurality of the first and the second holding grooves 225 and 226 for accommodating the contacts 21 individually. Each of the first and the second holding grooves 225 and 226 has the inner wall 234 extending in the first direction (or the height direction, or the Z-direction). Each of the contacts 21 has the fixed portion 212, the contact arm portion 213 and the support arm portion 214. The fixed portion 212 is fixed to the corresponding one of the first and the second holding grooves 225 and 226. The contact arm portion 213 and the support arm portion 214 extend from the fixed portion 212 in the first direction (or the height direction, or the Z-direction). The contact arm portion 213 and the support arm portion 214 are disposed at an interval between them in the second direction (or the depth direction, or the Y-direction) perpendicular to the first direction (or the height direction, or the Z-direction). The contact arm portion 213 has a contact point 217. The contact arm portion 213 is resiliently deformable to move the contact point 217 in the second direction (or the depth direction, or the Y-direction). The support arm portion 214 comes into contact with the inner wall 234 of the corresponding one of the first and the second holding grooves 225 and 226 at least when the contact arm portion 213 is resiliently deformed so that the contact point 217 comes close to the support arm portion 214.

According to the present embodiment, the aforementioned structure allows that the support arm portion 214 prevents or suppresses the turn of the contact 21. Consequently, fixing force required to the fixed portion 212 may be relatively small. Hence, the present embodiment can employ a fixing method regarded as that the contact 21 has only one fixing point in one direction (i.e. the Z-direction). Therefore, the contact 21 according to the present embodiment can reduce the height (or a size in the Z-direction) of the fixed portion 212 in comparison with the case of Patent Document 1 where the number of fixing points is three in one direction. As a result, reducing the profile of the connector 20 can be achieved.

Above all, the connector 20 according to the present embodiment has a following structure. The contact arm portion 213 and the support arm portion 214 are opposed to each other via a space in the second direction (or the depth direction, or the Y-direction). This allows the contact arm portion 213 to deform resiliently toward the support arm portion 214.

In the connector 20 according to the present embodiment, the fixed portion 212 is press-fit into the corresponding one of the first and the second holding grooves 225 and 226. Accordingly, assembly is easy. Moreover, the fixed portion 212 protrudes in the second direction (or the depth direction, or the Y-direction) in comparison with the contact arm portion 213. This makes press-fitting of the contact 21 easy and prevents the contact arm portion 213 from being damaged upon the press-fitting of the contact 21. In addition, the fixed portion 212 has the end face 216 on the same plane as the surface of the support arm portion 214. Accordingly, when the fixed portion 212 tries to be turned by external force, the support arm portion 214 comes into contact with the inner wall 234 immediately to be able to oppose the turning force caused in the fixed portion 212.

In the connector 20 according to the present embodiment, the support arm portion 214 has a larger size than that of the contact arm portion 213 in the second direction (or the depth direction, or the Y-direction). Accordingly, the support arm portion 214 is not deformed by external force having a strength which deforms the contact arm portion 123.

In the connector 20 according to the present embodiment, each of the first and the second holding grooves 225 and 226 has the bottom face 231. The inner wall 234 extends from the bottom face 231 in the first direction (or the height direction, or the Z-direction). The fixed portion 212 comes into contact with the bottom face 231 of the corresponding one of the first and the second holding grooves 225 and 226 at least when the contact arm portion 213 is resiliently deformed so that the contact point 217 comes close to the support arm portion 214. Consequently, in addition to the combination of the support arm portion 214 and the inner wall 234, the combination of the fixed portion 212 and the bottom face 231 can prevent or suppress the turn of the contact 21.

In the connector 20 according to the present embodiment, each of the contacts 21 is the contact formed by punching out the metal sheet so that the metal sheet has the main surface parallel to both of the first (or the height direction, or the Z-direction) and the second direction (or the depth direction, or the Y-direction). The contact 21 is easy to be manufactured.

In the connector 20 according to the present embodiment, the housing 22 has the holding portions 221 extending in the third direction (or the width direction, or the X-direction) perpendicular to both of the first direction (or the height direction, or the Z-direction) and the second direction (or the depth direction, or the Y-direction). The plurality of the holding grooves 225 and 226 includes at least one first holding groove 225 and at least one second holding groove 226 that are alternately arranged in the holding portion 221 at the predetermined interval. The first holding groove 225 has the opening portion opened in the wall surface 223, i.e. one of the pair of the wall surfaces arranged in the second direction (or the depth direction, or the Y-direction) of the holding portion 221. On the other hand, the second holding groove 226 has the opening portion opened in the wall surface 224, i.e. the other of the pair of the wall surfaces arranged in the second direction (or the depth direction, or the Y-direction) of the holding portion 221. Each of the contacts 21 is accommodated by the corresponding one of the first and the second holding grooves 225 and 226 so that at least the contact point 217 thereof is exposed from the opening portion of the corresponding one of the first and the second holding grooves 225 and 226. The contacts 21 are arranged to alternate the directions of their front faces. In other words, the direction of the front face of each contact 21 is opposite to the direction of the front face of the adjacent contact 21 adjacent thereto in the second direction (or the depth direction, or the Y-direction). When the connecting terminal portion 211 of each contact 21 is biased to one side (frontward or rearward) in the second direction (or the depth direction, or the Y-direction), the interval between the adjacent two of the connecting terminal portions 211 of the adjacent two of the contacts 21 can be larger than that between the adjacent two of the contacts 21. Hence, the interval between the adjacent contacts 21 can be reduced to downsize the connector 20 while the short circuit is prevented between the adjacent contacts 21.

In the present embodiment, the support arm portion 214 is longer than the contact arm portion 213 in the Z-direction. This is favorable to press-fit the contact 21 into the corresponding one of the first and the second holding grooves 225 and 226. However, the support arm portion 214 may be shorter than the contact arm portion 213 in the Z-direction. In particular, in a case where the first and the second holding grooves 225 and 226 are formed so that the contacts 21 are press-fit into them from the bottom face of the housing 22, it is unnecessary that the support arm portion 214 is longer than the contact arm portion 213 in the height direction. Because the support arm portion 214 has only to oppose the moment caused in the contact 21 by coming into contact with the inner wall 234, the support arm portion 214 has only to protrude from the fixed portion 212 in the height direction or the Z-direction. Even if the support arm portion 214 protrudes a little from the fixed portion 212, the turn of the contact 21 can be prevented or suppressed. Accordingly, the support arm portion 214 does not obstruct reduction of the height (or the length in the Z-direction) of the contact 21.

As mentioned above, the present embodiment allows the height of the fixed portion 212 of the contact 21 to be reduced and thereby achieving a lower profile of the connector 20. Therefore, the reduction of the profile of the connector assembly 10 can be achieved.

Second Embodiment

In the first embodiment, the contact 21 of the connector 20 is formed by punching out the metal sheet. In contrast, a connector according to a second embodiment uses a contact 21A made of a metal wire rod shown in FIG. 31.

Figure 31:
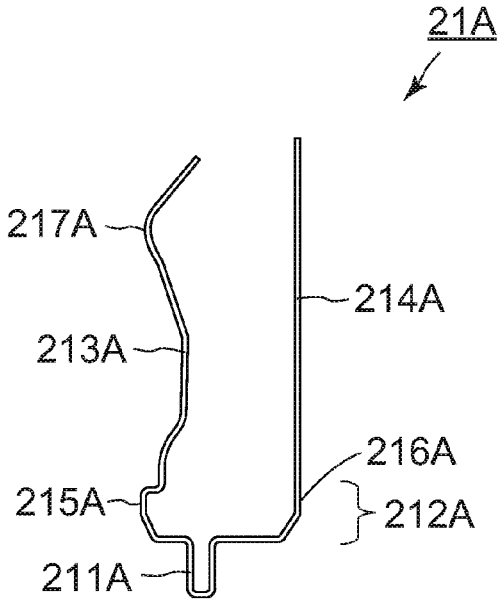
FIG. 31 is a side view of a contact included in a connector according to a second embodiment of the invention.
Figure 32:
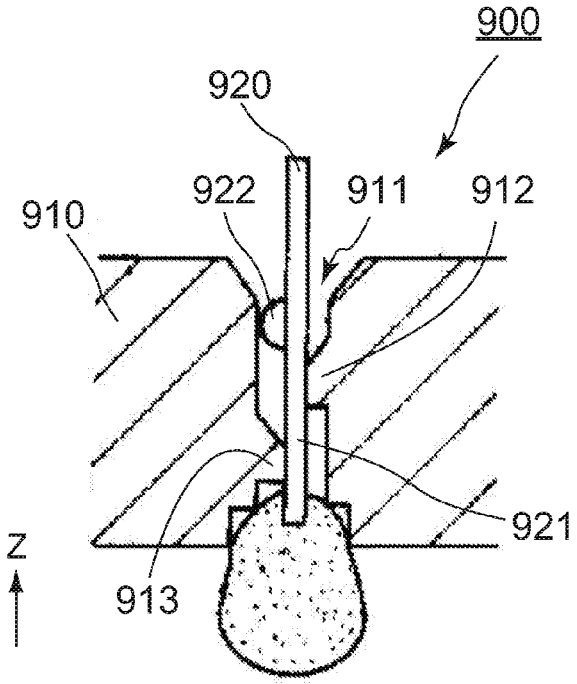
FIG. 32 is a partial cross-sectional view of a connector of Patent Document 1.

As understood from FIG. 31, the contact 21A used in the connector according to the present embodiment is formed by bending the metal wire rod. In other words, the contact 21A is a contact formed by bending the metal wire rod. The contact 21A has an outer shape corresponding to that of the contact 21 used in the first embodiment. That is, the contact 21A has a connecting terminal portion 211A, a fixed portion 212A, a contact arm portion 213A and a support arm portion 214A which are made of the metal wire rod. The fixed portion 212A has two parts which are continued to the contact arm portion 213A and the support arm portion 214A, respectively. One of the two parts of the fixed portion 212A includes an end face 215A while the other includes an end face 216A. The two parts forming the fixed portion 212A are coupled with each other via the connecting terminal portion 211A and thereby maintaining a predetermined interval between the end face 215A and the end face 216A. The contact arm portion 213A has a contact point 217A.

As understood from FIGS. 31 and 24, the end faces 215A and 216A of the fixed portion 212A come into line contact with the inner walls 232 and 234, respectively, of the corresponding one of the first and the second holding grooves 225 and 226. Other points are similar to those of the first embodiment, and the detailed explanation thereof will be omitted.

The present embodiment achieves advantages similar to those of the first embodiment. The present embodiment achieves weight reduction by using the contact 21A as compared with a case of using the contact 21.

Although the specific embodiments of the present invention are described above, the present invention is not limited thereto and various modifications and applications can be allowed.

For example, although the connector in each of the aforementioned embodiments has a rectangular outer shape when seen along the first direction, it may have another outer shape such as a square or a circle.

The present application is based on a Japanese patent application of JP2015-104237 filed before the Japan Patent Office on May 22, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a plurality of contacts; and a housing having a plurality of holding grooves which accommodate the contacts, respectively, wherein:

each of the holding grooves has an inner wall extending in a first direction;

each of the contacts has a fixed portion, a contact arm portion and a support arm portion;

the fixed portion is fixed in a corresponding one of the holding grooves;

the contact arm portion and the support arm portion extend from the fixed portion in the first direction, individually, and are disposed apart from each other in a second direction perpendicular to the first direction;

the contact arm portion and the support arm portion are opposed to each other in the second direction via a space;

the contact arm portion has a contact point and is resiliently deformable to move the contact point in the second direction; and the support arm portion comes into contact with the inner wall of the corresponding one of the holding grooves at least when the contact arm portion is resiliently deformed so that the contact point comes close to the support arm portion.

2. The connector as recited in claim 1, wherein the fixed portion is press-fit into the corresponding one of the holding grooves.

3. The connector as recited in claim 1, wherein the fixed portion protrudes in the second direction in comparison with the contact arm portion.

4. The connector as recited in claim 1, wherein the fixed portion has an end face on a same plane as a surface of the support arm portion.

5. The connector as recited in claim 1, wherein the support arm portion has a larger size than that of the contact arm portion in the second direction.

6. The connector as recited in claim 1, wherein:

each of the holding grooves has a bottom face;

the inner wall extends from the bottom face in the first direction; and the fixed portion comes into contact with the bottom face of the corresponding one of the holding grooves at least when the contact arm portion is resiliently deformed so that the contact point comes close to the support arm portion.

7. The connector as recited in claim 1, wherein each of the contacts is a contact formed by punching out a metal sheet so that the metal sheet has a main surface parallel to both of the first direction and the second direction.

8. The connector as recited in claim 1, wherein each of the contacts is a contact formed by bending a metal wire rod.

9. The connector as recited in claim 1, wherein:

the housing has a holding portion extending in a third direction perpendicular to both of the first direction and the second direction;

the holding portion has a pair of wall surfaces arranged in the second direction;

the holding grooves have at least one first holding groove and at least one second holding groove which are alternately formed at predetermined intervals in the holding portion;

the first holding groove has an opening opened at one of the pair of the wall surfaces while the second holding groove has an opening opened at a remaining one of the pair of the wall surfaces; and each of the contacts is accommodated by the corresponding one of the holding grooves so that at least the contact point is exposed through the opening of the corresponding one of the holding grooves.

10. A connector assembly comprising the connector as recited in claim 1 and a mating connector mateable with the connector.

11. A connector comprising:

a plurality of contacts; and a housing having a plurality of holding grooves which accommodate the contacts, respectively, wherein:

each of the holding grooves has an inner wall extending in a first direction;

each of the contacts has a fixed portion, a contact arm portion and a support arm portion;

the fixed portion is fixed in a corresponding one of the holding grooves;

the contact arm portion and the support arm portion extend from the fixed portion in the first direction and are disposed apart from each other in a second direction perpendicular to the first direction;

the contact arm portion has a contact point and is resiliently deformable to move the contact point in the second direction;

the support arm portion comes into contact with the inner wall of the corresponding one of the holding grooves at least when the contact arm portion is resiliently deformed so that the contact point comes close to the support arm portion; and each of the contacts is a contact formed by bending a metal wire rod.

* * * * *